US005157419A

United States Patent [19]

Matsumoto et al.

[11] Patent Number: 5,157,419

[45] Date of Patent: Oct. 20, 1992

[54] RECORDING HEAD SUBSTRATE HAVING A FUNCTIONAL ELEMENT CONNECTED TO AN ELECTROTHERMAL TRANSDUCER BY A LAYER OF A MATERIAL USED IN A HEATER LAYER OF THE ELECTROTHERMAL TRANSDUCER

[75] Inventors: Shigeyuki Matsumoto, Atsugi; Asao Saito, Yokohama, both of Japan

[73] Assignee: Canon Kabushiki Kaisha, Tokyo, Japan

[21] Appl. No.: 625,107

[22] Filed: Dec. 10, 1990

[30] Foreign Application Priority Data

Dec. 11, 1989 [JP] Japan ..... 1-322314

[51] Int. Cl.[5] ..... B41J 2/05

[52] U.S. Cl. ..... 346/140 R; 357/51; 357/71

[58] Field of Search ..... 346/140; 357/71, 48, 357/51

[56] References Cited

U.S. PATENT DOCUMENTS

| | | | |
|---|---|---|---|
| 4,313,124 | 1/1982 | Hara . | |
| 4,345,262 | 8/1982 | Shirato . | |
| 4,429,321 | 1/1984 | Matsumoto | 346/140 |
| 4,459,600 | 7/1984 | Sato . | |
| 4,463,359 | 7/1984 | Ayata . | |
| 4,723,129 | 2/1988 | Endo . | |
| 4,740,796 | 4/1988 | Endo . | |
| 4,819,052 | 4/1989 | Hutter | 357/71 X |
| 4,910,578 | 3/1990 | Okamoto | 357/71 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—Joseph W. Hartary

*Attorney, Agent, or Firm*—Fitzpatrick, Cella, Harper & Scinto

[57] ABSTRACT

A recording head has a liquid emission section with an orifice for emitting ink, an electro-thermal transducer producing thermal energy for ink emission and a functional element electrically connected to the electro-thermal transducer. The functional element is connected to the transducer by a layer formed of the same material as a layer of a heat generating resistive layer constituting the electro-thermal transducer, which enables the formation of a large number of functional elements on a single substrate while maintaining the elements in electrical isolation without increasing manufacturing cost.

16 Claims, 11 Drawing Sheets

RECORDING HEAD SUBSTRATE HAVING A FUNCTIONAL ELEMENT CONNECTED TO AN ELECTROTHERMAL TRANSDUCER BY A LAYER OF A MATERIAL USED IN A HEATER LAYER OF THE ELECTROTHERMAL TRANSDUCER

BACKGROUND OF THE INVENTION

1. Field of the Invention

The present invention relates to a recording apparatus adapted for use as an output printer for a copying machine, a facsimile apparatus, a word processor or a host computer, or for use as a video output printer, and more particularly to a recording head having electrothermal converting elements and recording functional devices on the same substrate and adapted for use in such recording apparatus.

2. Related Background Art

A conventional recording head is constructed by forming an array of electrothermal converting elements on a monocrystalline silicon substrate, then arranging functional devices such as a transistor array, for driving said electrothermal converting elements, outside said silicon substrate, and connecting the electrothermal converting elements and the transistor array with a flexible cable or by wire bonding.

In order to achieve simplification of structure, decrease defects in the manufacture, improvement in uniformity of device characteristics and improvement in reproducibility in the above-explained structure, there is recently known an ink jet recording apparatus in which, as proposed in the Japanese Laid-open Patent Sho 57-72867, the electrothermal converting elements and functional devices are formed on a same substrate.

FIG. 5 is a partial cross-sectional view of such recording head, wherein shown are a semiconductor substrate 901 consisting of monocrystalline silicon; an N-type semiconductor collector area 902; an N-type semiconductor ohmic contact area 903 with a high impurity concentration; a P-type semiconductor base area 904; and an N-type semiconductor emitter area 905 of a high impurity concentration, and said areas constitute a bipolar transistor 920. There are further provided a silicon oxide layer 906 serving as a heat sink and insulating layer; a heat-generating resistor layer 907; an aluminum (Al) electrode 908; and a silicon oxide protective layer 909, and these layers constitute a substrate member 930 of the recording head, including a heat-generating part 940. A cover plate 910 defines a liquid path 950 in cooperation with the substrate member 930.

Although the above-explained structure is well designed, there is still a room for further improvement for sufficiently meeting the requirements of energy saving, high level of integration, cost reduction and satisfactory reliability needed in recent recording apparatus.

In the first place, for achieving commercial success, a recording head of high performance has to be supplied with a low price. For this purpose, a recording head of low cost has to be realized by integrating the functional devices at a high density and thereby reducing the area of the chip constituting the substrate member of the recording head.

Consequently, it has been attempted to realize a higher level of integration, by employing a shallower emitter area in the transistor serving as the functional than in the above-explained structure, thereby reducing the design margin.

In such a base member for a recording head, a shallower structure of the diffused emitter area 905 allows limiting the lateral expansion of diffusion, thereby achieving a higher level of integration without sacrificing the voltage resistance, and also reducing the diffused capacity between the emitter area 905 and the base area 904.

However, ink jet recording with a recording head employing a substrate member obtained by forming the electrothermal converting elements on a substrate with such shallower base area has often resulted in failures in ink discharge. Analysis of this phenomenon has revealed that aluminum employed in the emitter electrode wiring 908 has caused a eutectic reaction with silicon contained in the substrate 901, thus developing alloy, called a spike, at the interface of the emitter area 905 and the emitter electrode, and said spike has reached the base area 904 penetrating the emitter area 905 and short-circuiting the emitter and the base areas. In addition to such point requiring further improvement, following factors have to be taken into consideration.

On a substrate member for use in a recording head for the above-mentioned ink jet recording method, for example the one disclosed in the U.S. Pat. No. 4,723,129 issued to Endo et al., there have to be formed electrothermal converting elements capable of generating thermal energy sufficient for inducing a state change in the ink and thereby discharging ink from discharge openings. On the other hand, functional semiconductor devices such as diodes or transistors have a temperature dependence in their characteristics and should therefore be operated, as far as possible, under stable temperature conditions.

Consequently, a completely new concept is required in the structure of the recording head and the substrate member therefor, in order to incorporate components of mutually contradictory properties on a same substrate member (including the case of forming the functional devices on a semiconductor substrate) and to achieve satisfactory functions of these components while preventing the formation of the aforementioned spikes. Besides, such recording head has to be formed with a low cost.

SUMMARY OF THE INVENTION

An object of the present invention is to resolve the above-mentioned technical drawbacks and to provide a recording head capable of achieving stable high-speed recording and a high resolving power, and a substrate member therefor.

Another object of the present invention is to provide a recording head of a high level of integration and a high reliability, and a substrate member therefor, with a low cost.

Still another object of the present invention is to provide a recording head capable of saving electric power consumption, and a substrate member therefor.

Still another object of the present invention is to provide a recording head comprising:

a liquid emission section having an orifice for emitting an ink;

an electrothermal transducer producing a thermal energy for use in emission of the ink supplied to said a liquid emission section; and a functional element electrically connected to said electrothermal transducer, wherein said functional element has a layer formed from the same material as that of a heat generating resistive layer constituting said electro-thermal transducer.

BRIEF DESCRIPTION OF THE DRAWINGS

FIGS. 4A to 4K are cross-sectional views showing the process for producing the recording head of the present invention;

DETAILED DESCRIPTION OF THE PREFERRED EMBODIMENTS

The present invention will now be clarified in detail by describing a non-limitative embodiment shown in the attached drawings.

Figure 1:
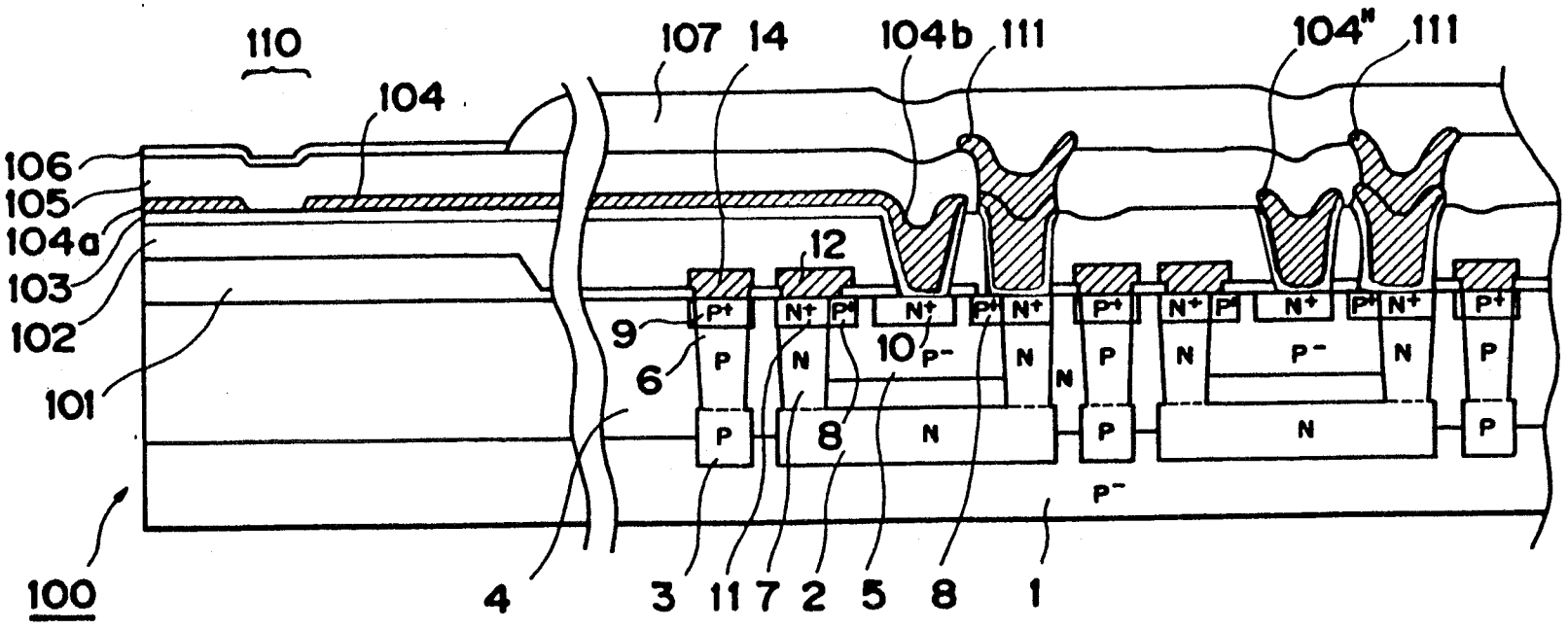
FIG. 1 is a schematic cross-sectional view of an example of the substrate member for a recording head of the present invention.

FIG. 1 is a schematic cross-sectional view of an example of the substrate member for the recording head of the present invention, wherein shown are a P-type silicon substrate 1; an N-type embedded collector area 2 for forming a functional device; a P-type embedded isolation area 3 for isolating the functional device; an N-type epitaxial area 4; a P-type base area 5 for forming the functional device; a P-type isolation area 6 for device isolation; an N-type collector area 7 for forming the functional device; a highly doped P-type base area 8 for device formation; a highly doped P-type isolation area for device isolation; an N-type emitter area 10 for device formation; a highly doped N-type collector area 11 for device formation; a collector-base common electrode 12; and an isolation electrode 14. Thus there is formed an NPN transistor, in which collector areas 2, 4, 7, 11 completely surround the emitter area 10 and the base areas 5, 8. Each cell is surrounded and electrically isolated by the P-type embedded isolation area 3, P-type isolation area 6 and highly doped P-type isolation area 9.

The recording head 100 of the present embodiment is provided, on a substrate member having the driving unit explained above, with a $SiO_2$ film 101 formed by thermal oxidation, a heat accumulating layer 102 composed of a silicon oxide film formed by PCVD or sputtering, and an electrothermal converting element composed of a heat-generating resistor layer 103 consisting for example of sputtered $HfB_2$ and electrodes 104 consisting for example of evaporated aluminum. The heat-generating resistor layer 103 of $HfB_2$ is provided also between, the N-type emitter area 10 and a wiring 104" of aluminum, for example.

The present inventors have experimentally found that $HfB_2$ is an excellent material in making contact with the aluminum electrode, diode and semiconductor area.

However the heat-generating resistor layer may be optionally composed of another material, such as Ta, $ZrB_2$, Ti-W, Ni-Cr, Ta-Al, Ta-Si, Ta-Mo, Ta-W, Ta-Cu, Ta-Ni, Ta-Ni-Al, Ta-Mo-Ni, Ta-W-Ni, Ta-Si-Al or Ta-W-Al-Ni.

Thus, since the heat generating resistive layer is inserted between the functional element and the electrode, a spike due to a connection between the Al electrode and the substrate is prevented. Further, since the same material or the same layer as that of the electrothermal transducer is used, the producing process is simplified and thermal homogeneity can be obtained.

On the heat generating part of the electrothermal converting element, there are provided a protective film 105 for example of $SiO_2$, and a protective film 106 for example of Ta, formed by CVD.

The $SiO_2$ film constituting the heat accumulation layer 102 is integral with an interlayer insulation film between lowermost wirings 12, 14 and intermediate wirings 104, **104*b*** of the driving part.

Similarly the protective layer 105 is integral with an interlayer insulation film between the intermediate wirings 104, **104*b* and an uppermost wiring 111**.

On said uppermost wiring 111 of the driving part, there is provided a protective layer 107, composed of an organic material such as photosensitive polyimide and serving as an insulation film with sufficient resistance to the recording liquid.

In the following there will be explained the basic function of the above-explained driving unit, with reference to FIG. 2 for explaining the driving method of the recording head shown in FIG. 1.

Figure 2:
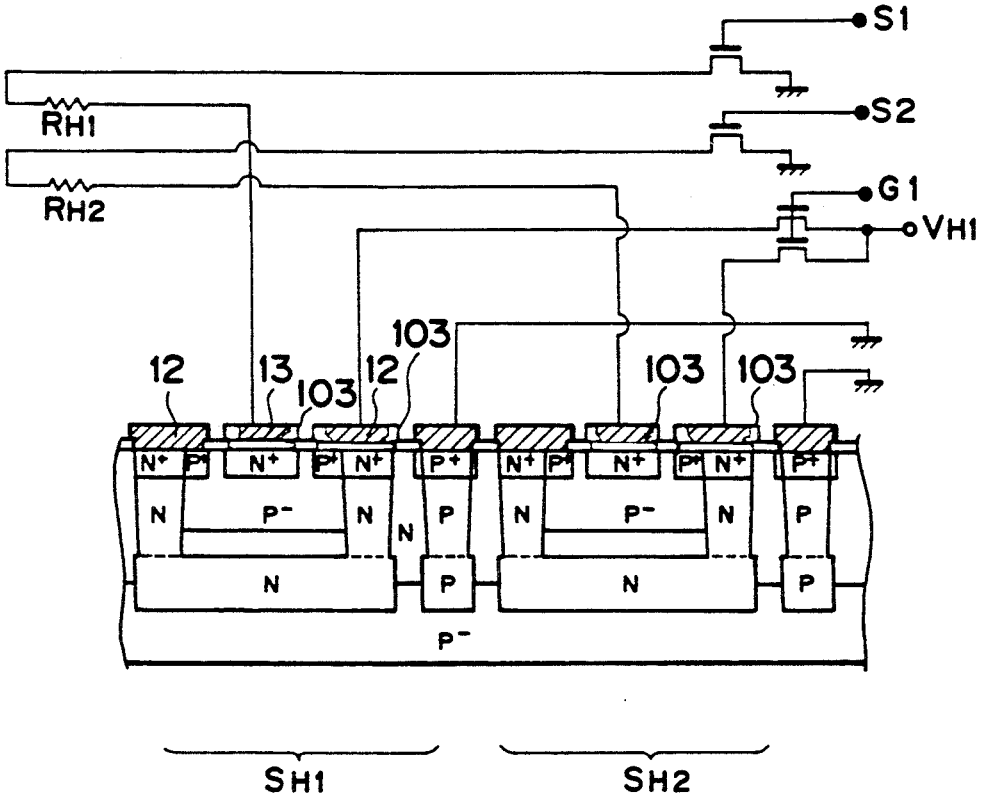
FIG. 2 is a schematic view showing the driving method of the recording head of the present invention.

In the present embodiment, as shown in FIGS. 1 and 2, the collector-base common electrode 12 corresponds to the anode of a diode, and the emitter electrode 13 (corresponding to **104*b*) corresponds to the cathode of said diode. Thus, application of a positive bias voltage $V_{H1}$ to the collector-base common electrode 12 turns on the NPN transistor in the cell, whereby the bias current flows, as the collector current and the base current, from the emitter electrode 13**. The shortcircuited structure of the base and collector of the present invention, as shown in FIGS. 1 and 2, improves the response of start and termination of heat generation of the electrothermal converting element, thereby facilitating the film boiling phenomenon and improving the control of expansion and contraction of the generated bubble, thus achieving stable ink droplet discharge. This is presumably because the characteristics of the,. transistor are closely related with the film boiling characteristics in the ink jet recording head utilizing thermal energy and the reduced accumulation of minor carriers in the transistor realizes fast switching and fast response. Also the above-explained structure has relatively limited parasite effects, thereby realizing uniform performance in the cells and providing stable driving current.

Also the present embodiment can prevent charge leakage to the neighboring cells by the grounding of the isolation electrode 14, thereby avoiding erroneous operation by the influence of other cells.

In the above-explained semiconductor device structure, it is desirable to maintain the impurity concentration of the N-type embedded collector area 2 at least at $1\times10^{19}$ cm$^{-3}$, to maintain that of the base area 5 in a range from $5\times10^{14}$ to $5\times10^{7}$ cm$^{-3}$, and to minimize the area of the junction between the highly doped base area 8 and the electrode, in order to prevent the formation of a leak current from the NPN transistor to the ground through the P-type silicon substrate 1 and the isolation area.

In the following further explanation will be given on the driving method for the above-explained recording head. Although FIGS. 1 and 2 illustrate only two semiconductor functional devices (cells), in practice such devices of a larger number are provided respectively corresponding to the electrothermal converting elements for example 128 in number, and are electrically connected in a matrix for enabling block driving.

In the following there will be explained the driving method of electrothermal converting resistor elements RH1, RH2 constituting two segments in a group.

At first, for driving the element RH1, the corresponding group is selected by a switch G1 and said element RH1 is selected by a switch S1. Thus the diode cell SH1 having the structure of a transistor is forward biased and powered to effect heat generation in the electrothermal converting element RH1. The resulting thermal energy induces a state change in the liquid, thereby generating a bubble and discharging liquid from a discharge opening.

Also in case of activating the electrothermal converting element RH2, the switches G1 and S2 are selectively closed to drive the diode cell SH2, thereby supply current to the electrothermal converting resistor.

In this state the substrate 1 is grounded through the isolation areas 3, 4, 6. Thus the presence of said isolation areas 3, 4, 6 of each semiconductor cell prevents erroneous operation resulting from electric interference between the cells.

Figure 3:
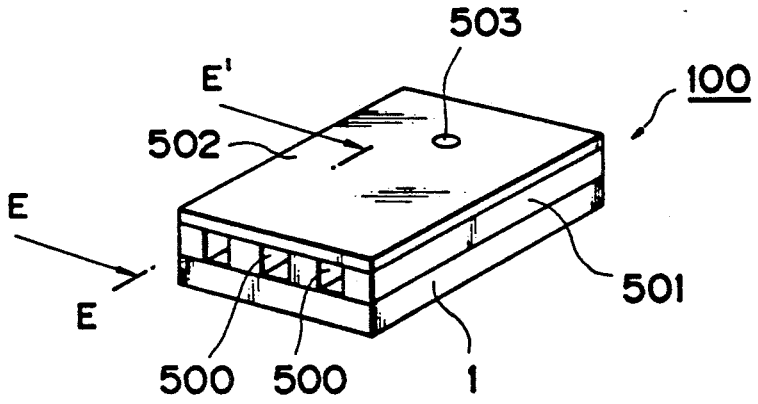
FIG. 3 is a schematic external perspective view of the recording head of the present invention.

FIG. 3 shows the constructed recording head, provided with plural discharge openings 500, liquid path wall member 501 composed for example of photosensitive resin for defining liquid paths communicating with said discharge openings, a cover plate 502, and an ink supply aperture 503.

In the following there will be explained an example of the manufacturing process of the recording head of the present embodiment, with reference to FIGS. 4A to 4K.

(1) At first a silicon oxide film of a thickness of 5000–20000 Å was formed on a P-type silicon substrate 1 with an impurity concentration of $1\times10^{12}$–$10^{16}$ $cm^3$.

Said silicon oxide film was removed by a photolithographic process in a part, where the embedded collector area 2 is to be formed, in each cell.

After the removal of the silicon oxide film, ions of N-type impurity such as P or As were implanted, and an N-type embedded collector area 2 with an impurity concentration of at least $1\times10^{19}$ $cm^{-3}$ and a thickness of 10–20 μm was prepared by thermal diffusion. In this state the sheet resistance was made low, not exceeding 30 Ω/□.

Then the oxide film was removed in an area where the P-type embedded isolation area 3 is to be formed, and, after the formation of an oxide film of a thickness of 100–3000 Å, ions of a P-type impurity such as B are implanted. Thus the P-type embedded isolation area 3 with an impurity concentration of $1\times10^{17}$–$10^{19}$ $cm^{-3}$ was prepared by thermal diffusion (This state being shown in FIG. 4A).

Figure 4A:
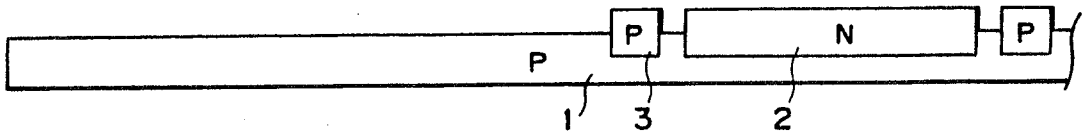
Figure 4B:
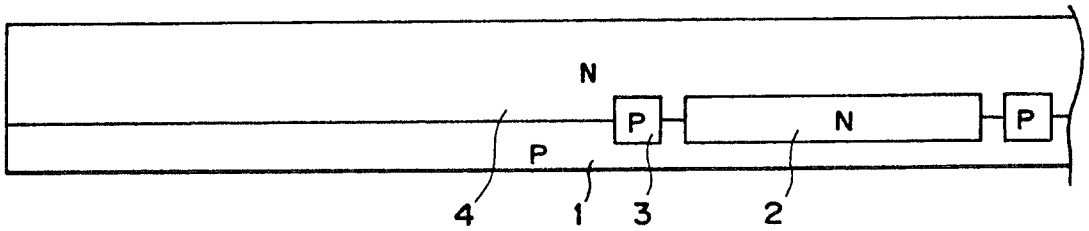

(2) After the removal of the oxide film over the entire area, an N-type epitaxial area 4 with an impurity concentration of $1\times10^{12}$–$10^{16}$ $cm^{-3}$ was epitaxially grown with a thickness of 5–20 μm (FIG. 4B).

(3) Then a silicon oxide film of a thickness of 100–300 Å was formed on the surface of the N-type epitaxial area, then photoresist was coated thereon and patterned, and ions of a P-type impurity were implanted in an area where the low impurity concentration base area 5 is to be formed. After the removal of photoresist, the P-type base area 5 of a low impurity concentration of $5\times10^{14}$–$5\times10^{17}$ $cm^{-3}$ was prepared with a thickness of 5–10 μm, by thermal diffusion.

Figure 4C:
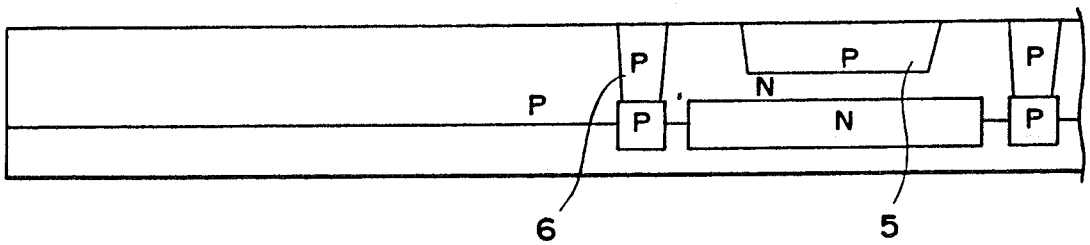

Subsequently the oxide film was removed over the entire area, and a silicon oxide film of a thickness of 1000–10000 Å was formed and then removed in an area where the P-type isolation area 6 is to be formed. A BSG film was deposited by CVD and thermal diffusion was applied to form the P-type isolation area 6 with an impurity concentration of $1\times10^{16}$–$10^{20}$ $cm^{-3}$ and a thickness of about 10 μm in such a manner as to reach the P-type embedded isolation area 3 (FIG. 4C). Said area may also be formed with $BBr_3$ as the diffusion source, or may naturally be formed by ion implantation.

(4) After the removal of the BSG film, a silicon oxide film of a thickness of 1000–10000 Å was formed and removed in an area where the N-type collector area 7 is to be formed. Said area was doped with P-type ions by the formation of a PSG film, and thermal diffusion was applied to form the N-type collector area 7 in such a manner as to reach the embedded collector area 5. The sheet resistance in this state was made low, not exceeding 10 Ω/□. The thickness of said area was selected as about 10 μm, and the impurity concentration was selected as $10^{18}$–$10^{20}$ $cm^{-3}$.

Figure 4D:
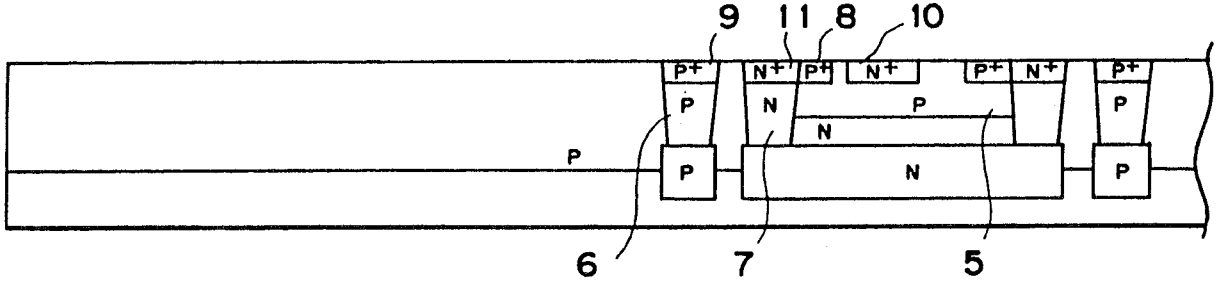

Subsequently the oxide film was removed from the cell area, a silicon oxide film of a thickness of 100–300 Å was formed and patterned with photoresist, and ions of a P-type impurity were implanted in areas where the highly doped base area 8 and the highly doped isolation area 9 are to be formed. After the removal of photoresist, the oxide film was removed in areas where the N-type emitter area 10 and the highly doped N-type collector area 11 are to be formed, and a PSG film was formed over the entire area to introduce $P^+$ ions into said areas. Then the highly doped P-type base area 8, highly doped P-type isolation area 9, N-type emitter area 10 and highly doped N-type collector area 11 were simultaneously formed by thermal diffusion. In this areas, the thickness was selected not exceeding 1.0 μm, and the concentration of impurity was selected as $1\times10^{19}10^{20}$ $cm^{-3}$ (FIG. 4D).

Figure 4E:
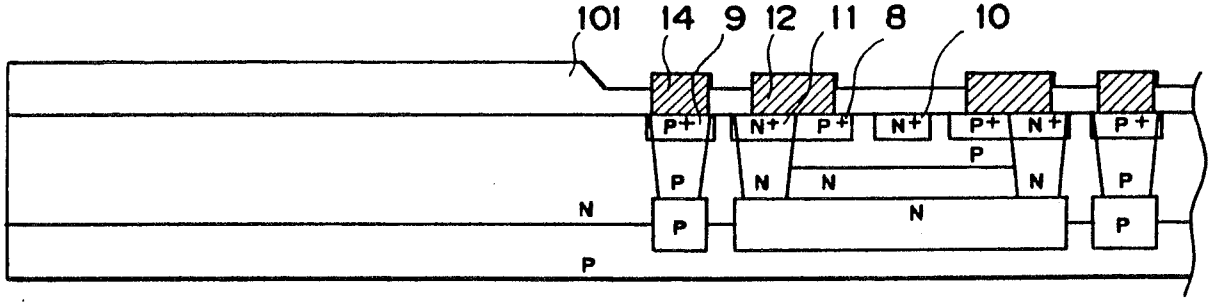

(5) The silicon oxide film was removed in the electrode connecting areas 12, 14, then aluminum was deposited over the entire surface and subsequently removed excluding said areas (FIG. 4E).

(6) Then a silicon oxide film 102, serving as the heat accumulation layer and interlayer insulation layer, was formed with a thickness of 0.4–1.0 μm by sputtering. Said film can also be formed by CVD.

Figure 4F:
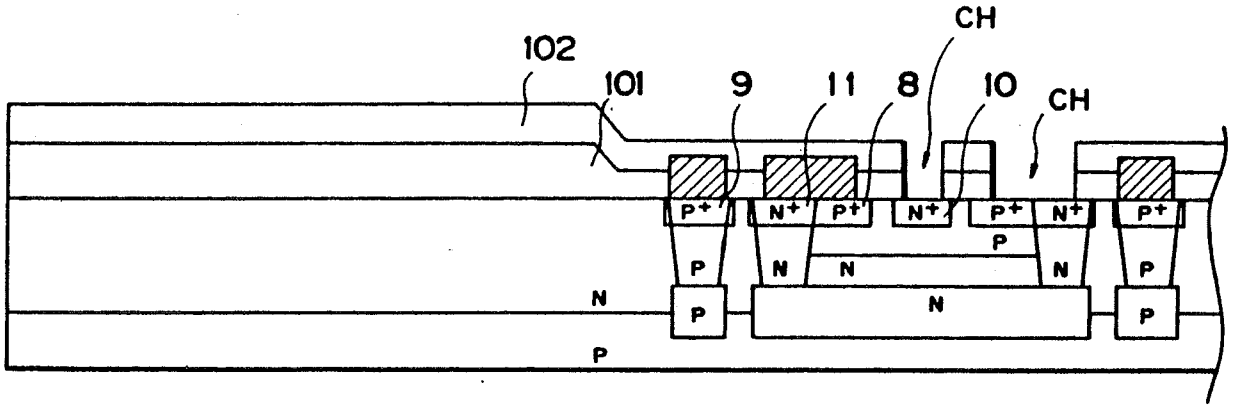

Subsequently, for making electrical connections, parts CH of the insulating films 101, 102, positioned above the emitter area and the base-collector area, were opened by a photolithographic process (FIG. 4F).

Figure 4G:
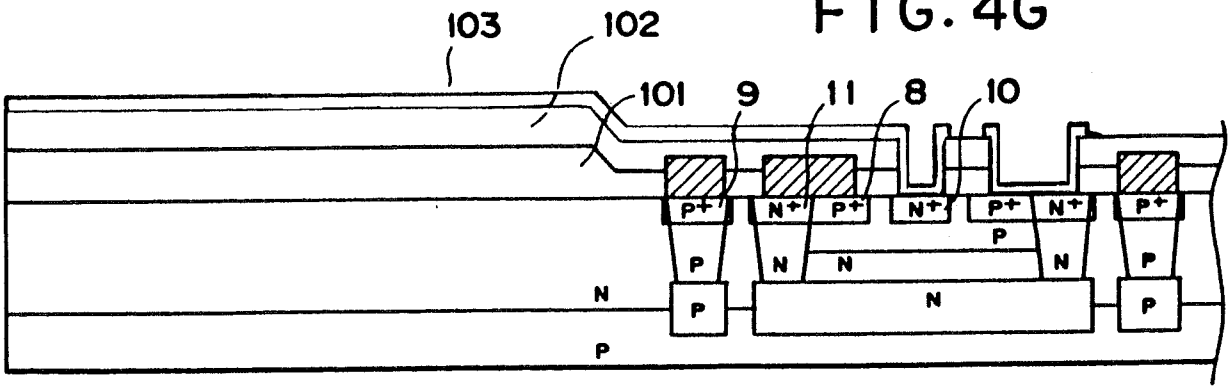
Figure 4H:
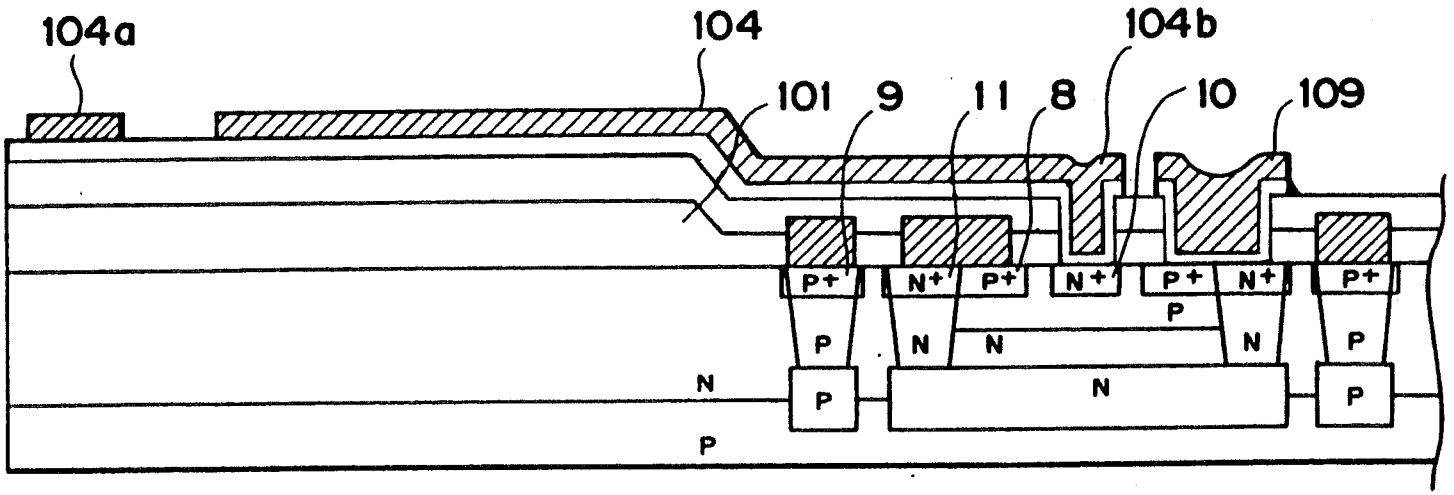
Figure 41:
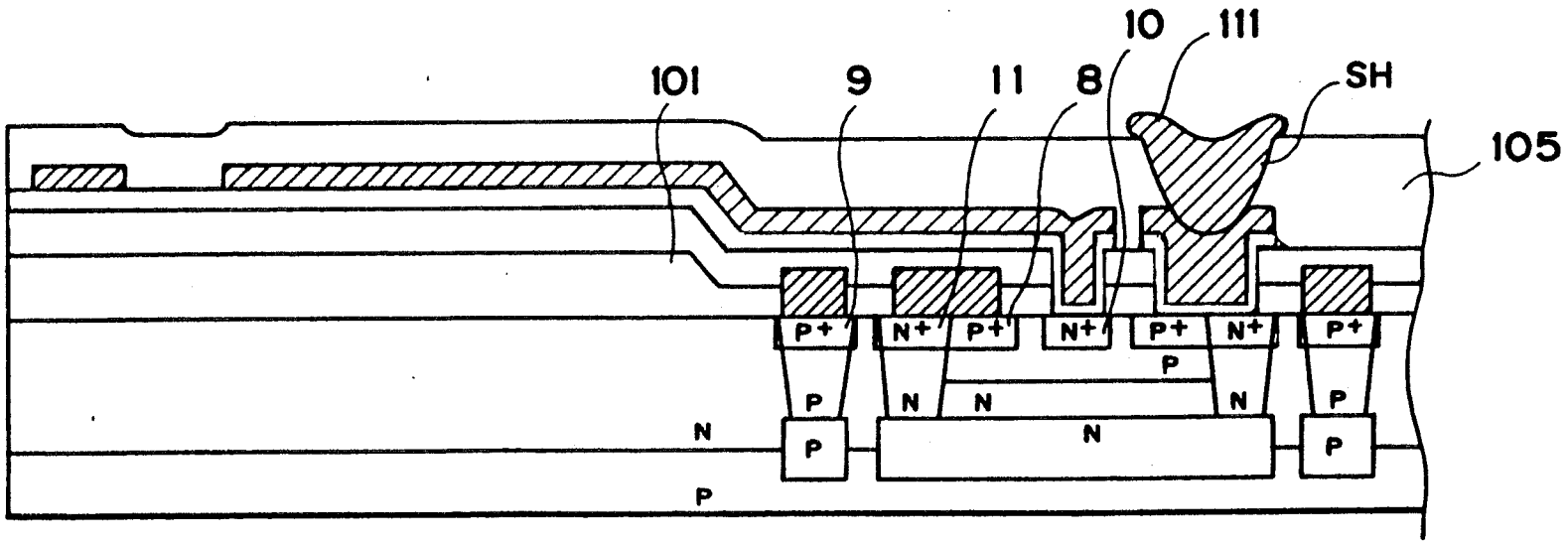

(7) Then $HfB_2$, constituting the heat generating resistor layer 103, was deposited with a thickness of about 1000 Å on the $SiO_2$ film 102 and, for making electrical connections, on the insulation film 101 positioned above the emitter area and the base-collector area, and was patterned (FIG. 4G).

(8) An aluminum layer, serving for the electrodes 104, **104*a* of the electrothermal converting element and the cathode wiring 104*b* and anode wiring 109** of the diode, was deposited and patterned to simultaneously form the electrothermal converting element and the wirings.

Thus a layer of the same material as that of the heat generating resistor layer 103 was formed between and electrically connected with the semiconductor area and the aluminum electrode.

(9) Subsequently an $SiO_2$ film 105, serving as the protective layer for the electrothermal converting element and the insulating layer between the aluminum wiring layers, was deposited by sputtering. Then a through hole SH for making the electrical connection with the upper wiring was formed, aluminium was deposited and patterned to form the wiring 111 (FIG. 4I).

Figure 4J:
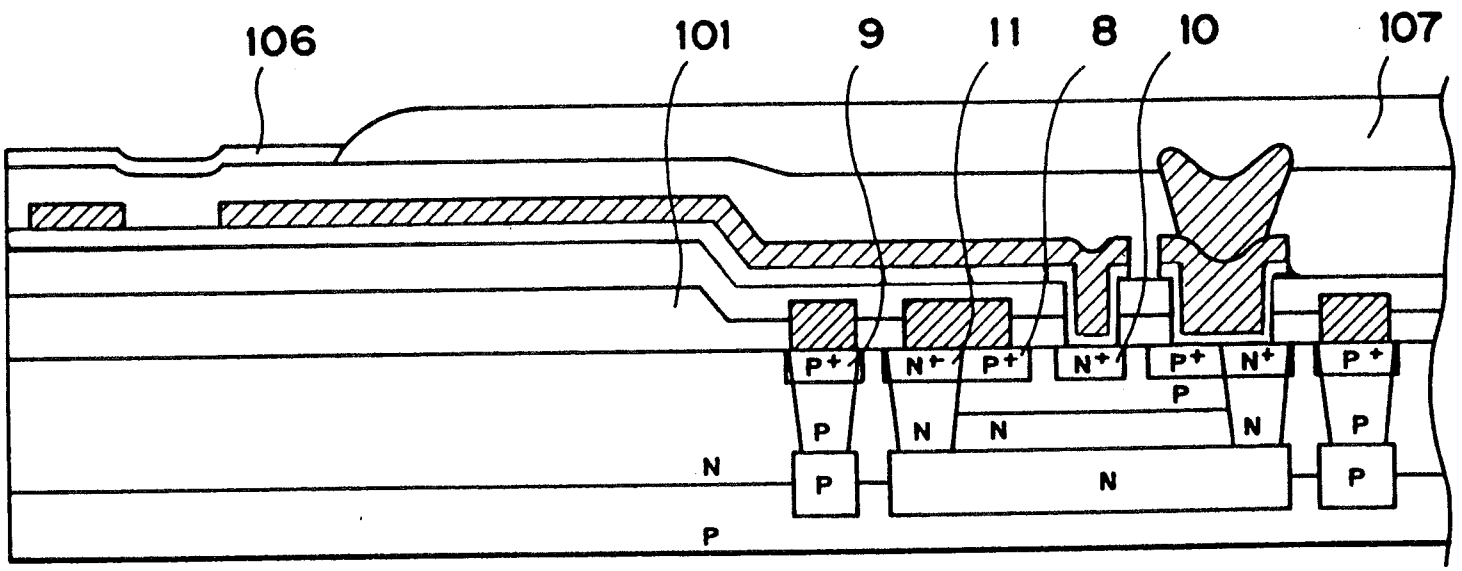

(10) On the heat generating part of the electrothermal converting element, Ta was deposited in a thickness of about 2000 Å as the protective layer 106 against cavitation, and photosensitive polyimide layer was formed in other areas as the protective layer 107 (FIG. 4J).

Figure 4K:
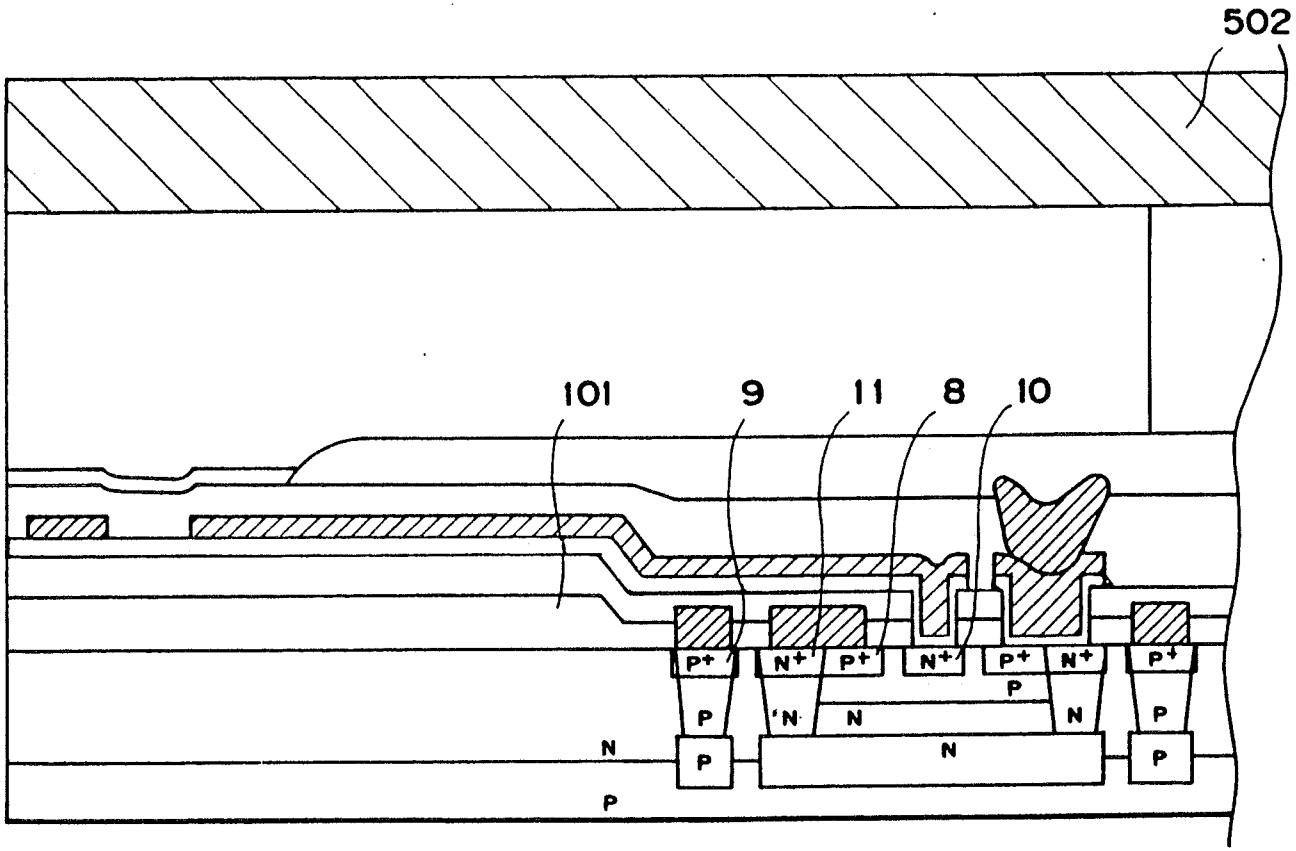
Figure 5:
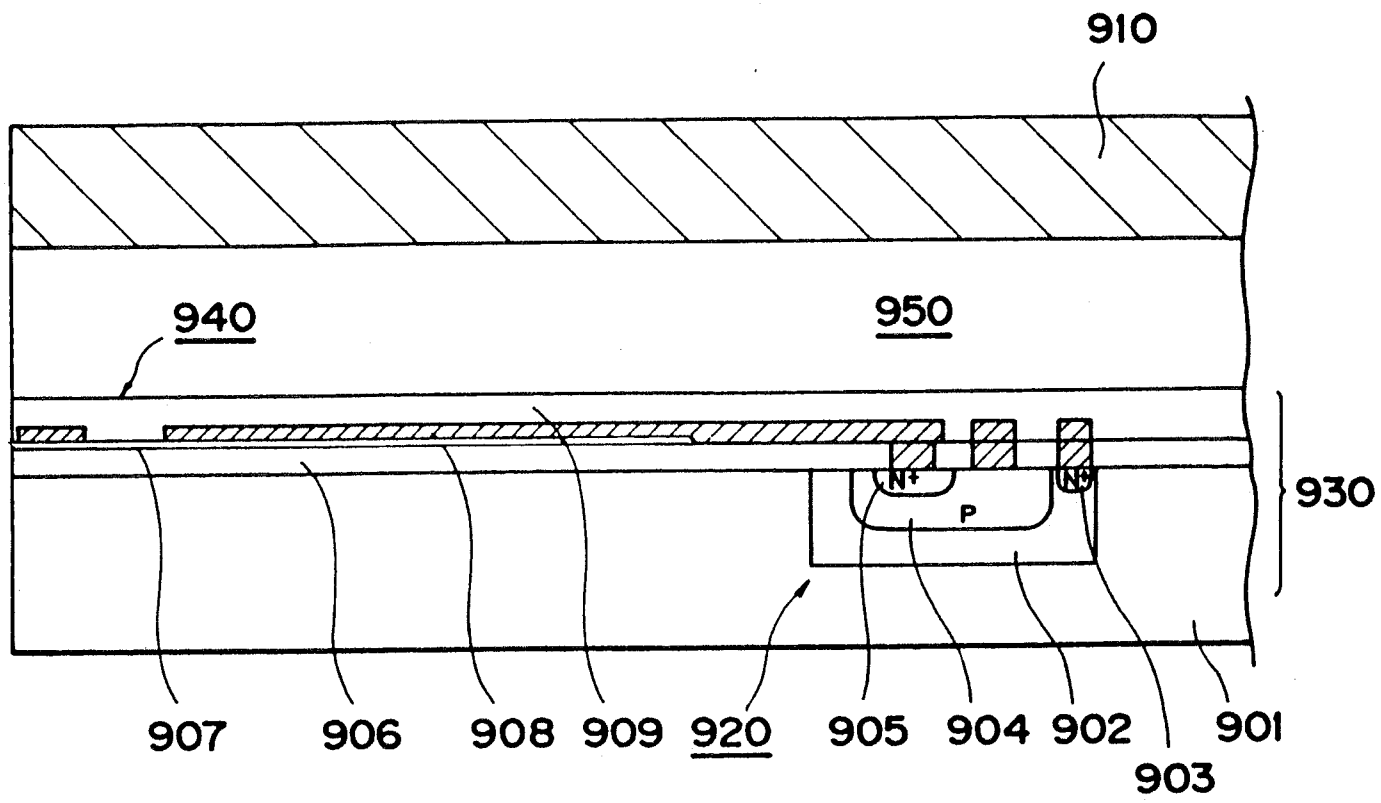
FIG. 5 is a schematic cross-sectional view of a recording head of the prior art.

(11) On the substrate member having thus prepared electrothermal converting elements and semiconductor devices, the liquid path wall members and the cover plate 502 were provided to complete the recording head having ink liquid paths therein (FIG. 4K).

In the above-explained structure, $HfB_2$ is present only in a part of the emitter electrode and the base-collector common electrode, but the presence of a layer of the same material as that of the heat generating resistor layer is desirable in order to prevent the shortcircuiting in the shallow emitter area.

The recording operation of such recording head was tested by block driving of the electrothermal converting elements. In said operation test, eight semiconductor diodes were connected in a segment and were respectively given a current of 300 mA (2.4 A in total), and satisfactory ink discharges could be obtained without erroneous functions of other semiconductor diodes.

The present invention is applicable also to a structure employing a PNP transistor.

As explained in the foregoing, the present invention allows to formation, on a same substrate, of plural semiconductor devices which have a high voltage resistance and are satisfactorily isolated from one another electrically.

Also the present invention resolves the technical drawback in realizing a shallow structure in the N-type emitter area, and realizes a high-density integration of functional devices without an increase in the number of process steps, thereby achieving cost reduction.

Also there can be provided an ink jet recording head which is featured by fast switching characteristics, improved response and reduced parasite effects, thereby achieving transfer of thermal energy in desirable manner to the liquid and improving the liquid discharge characteristics.

Figure 6:
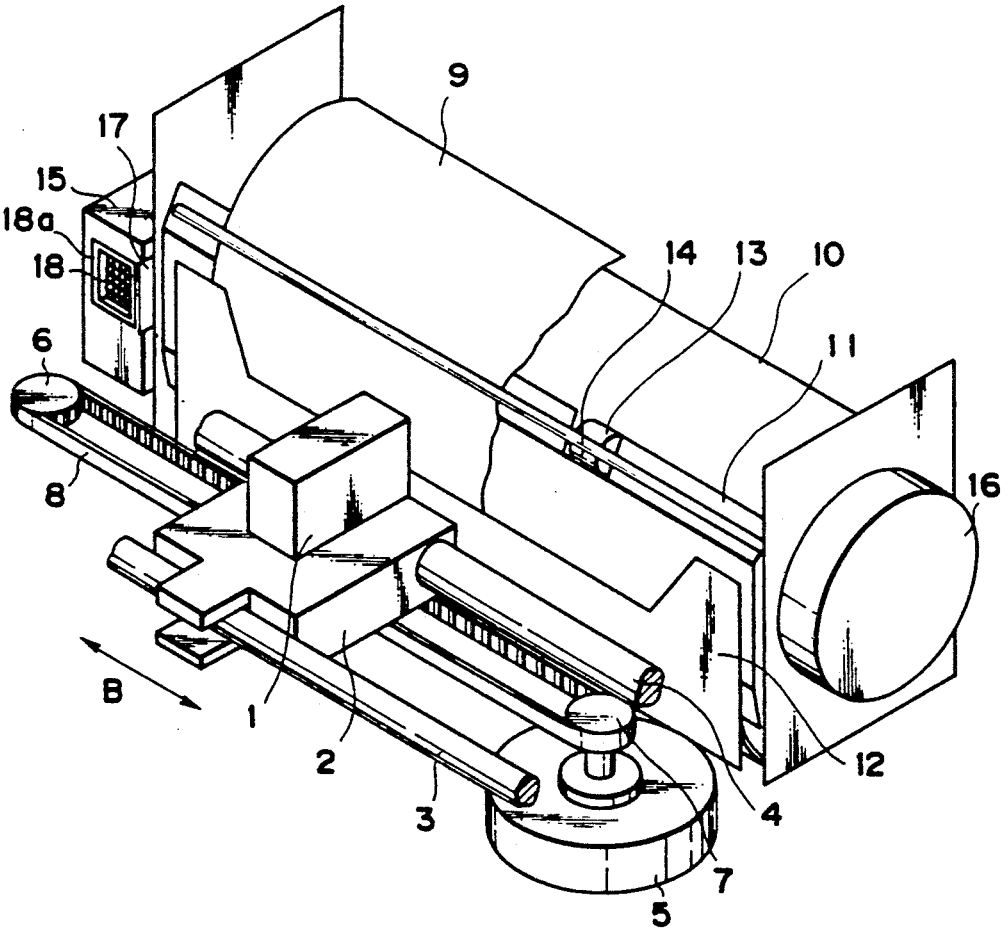
FIG. 6 PRIOR ART
FIG. 6 is a perspective view of an example of recording apparatus utilizing the recording head, and the substrate member therefor, of the present invention.

FIG. 6 is a schematic external perspective view of an ink jet recording apparatus employing the recording head, and the substrate member therefor, of the present invention, wherein shown are an ink jet recording head 1 for discharging ink according to recording signals to form a desired image (hereinafter referred to as recording head); and a carriage 2 supporting said recording head 1 and rendered capable of scanning motion in a direction of a recording line (main scanning direction B). Said carriage 2 is slidably supported by guide shafts 3, 4, and effects reciprocating motion by a timing belt 8 connected to said carriage. Said timing belt 8, supported by pulleys 6, 7, is driven by a carriage motor 5 linked with said pulley 7.

A recording sheet 9 is guided by a paper pan 10, and is transported by an unrepresented feed roller, maintained in contact with said sheet by a pinch roller, by means of a sheet feeding motor 16. The transported recording sheet 9, maintained under a tension by a discharge roller 13 and rollers 14 and also maintained in contact with a heater 11 by a pressure plate 12, advances in contact with said heater 11. The recording sheet 9, with the deposited ink discharged from the recording head 1, is thus heated by the heater 11, whereby said ink is dried by evaporation and is fixed onto the recording sheet 9.

A recovery unit 15 is provided for eliminating dust and viscosified ink deposited on the discharge openings (not shown) of the recording head 1, thereby maintaining proper ink discharge performance.

A cap 18*a*, constituting a part of the recovery unit 15, is provided for capping the discharge openings of the recording head 1, in order to prevent the blocking of said openings. An ink absorbent member 18 is provided inside said cap 18*a*.

At a side of the recovery unit 15 closer to the recording area, there is provided a cleaning blade 17 for contacting a face, having the discharge openings, of the recording head 1 and removing the dust and ink drops deposited on said face.

Among various ink jet recording methods, the present invention is particularly effective when applied to a recording head or a recording apparatus employing an ink jet recording method utilizing thermal energy for forming flying ink droplets for recording.

The representative principle and structure of said ink jet recording method are disclosed for example in the U.S. Pat. Nos. 4,723,129 and 4,740,796, and the present invention is preferably applied to the ink jet recording conducted on such basic principle. Said recording method is applicable to so-called on-demand or continuous recording.

In brief, said ink jet recording method is based on providing an electrothermal converting element, positioned corresponding to a sheet or a liquid path containing liquid (ink) therein, with at least a drive signal corresponding to the recording information and generating thermal energy for inducing a rapid temperature increase in said liquid enough for exceeding nucleate boiling phenomenon and causing film boiling on a thermal action plane of the recording head. This method is particularly suitable for on-demand recording, since bubbles can be formed in the liquid, respectively corresponding to the drive signals given to the electrothermal converting element. The liquid is discharged from a discharge opening to form at least a droplet, by the growth and contraction of said bubble. Said drive signal is preferably shaped as a pulse for achieving highly responsive liquid discharge, as the expansion and contraction of the bubble take place in rapid response. Said pulse shaped drive signal is preferably those disclosed in the U.S. Pat. Nos. 4,463,359 and 4,345,262. Also a further improved recording can be achieved by employing conditions disclosed in the U.S. Pat. No. 4,313,124 concerning the temperature rise rate of said thermal action plane.

The present invention includes the structure of the recording head obtained by the combinations of discharge openings, liquid paths and electrothermal converting elements as disclosed in the above-mentioned patents (linear or rectangular liquid path), but also a structure having the thermal action part in a bent area as disclosed in the U.S. Pat. No. 4,459,600.

The present invention is furthermore effective in a structure having a slit as a discharge opening common for plural electrothermal converting elements as disclosed in the Japanese Patent Application Laid-Open Gazette No. 59-123670, or in a structure having an opening for absorbing the pressure wave of thermal energy corresponding to the liquid discharge part as disclosed in the Japanese Patent Application Laid-Open Gazette No. 59-138461.

The present invention is furthermore effective applicable to a full-line recording head, capable of recording over the entire width of the recording material. Said full-line recording head may be obtained by the combination of a plurality of recording heads as disclosed in the above-cited patents, or may be an integrally constructed full-line recording head.

The present invention is furthermore effective for a replaceable chip-type recording head which can receive electric and ink supply from the recording apparatus itself when mounted thereon, or a recording head integral with an ink cartridge.

In the recording apparatus of the present invention, use of recovery means for the recording head or of auxiliary means is preferable in order to stabilize the function of the recording apparatus. Examples of such means for achieving stable recording includes capping means, cleaning means pressurizing or suction means for the recording head, preliminary heating means utilizing the electrothermal converting elements and/or other heating elements, and means for effecting a preliminary discharge mode, different from the ink discharge for recording.

Also with respect to the recording mode of the apparatus, the present invention is applicable not only in a recording apparatus designed for recording with a main color such as black, but also is extremely useful in apparatus for recording plural different colors or recording a full-color image by color mixing, either utilizing an integral recording head or a combination of plural recording heads.

Though the foregoing embodiments have been limited to the case of recording with liquid ink, the present invention is likewise applicable to ink which is solid or in softened state at room temperature. Any ink is usable as long as it is liquidous at the provision of the recording signal, since, in such ink jet recording apparatus, the ink is generally subjected to temperature control within a range from 30° C. to 70° C. for the purpose of maintaining the ink viscosity in a stably dischargeable state.

It is also possible to prevent excessive heating of the head or the ink by thermal energy by dissipating such excessive thermal energy in the state change of the ink from solid to liquid phase, and to utilize solid ink for the purpose of prevention of evaporation. Thus, in the present invention, there can be employed ink which is liquefied by the provision of thermal energy, such as ink that is liquefied and discharged by the supply of thermal energy corresponding to the recording signal or ink that already starts to solidify at the arrival at the recording medium.

Such ink can be positioned to the electrothermal converting elements, in a liquid or solid state contained in recesses or penetrating holes of a porous sheet, as disclosed in the Japanese Patent Application Laid-Open Gazette Nos. 54-56847 and 60-71260.

For such various types of ink, the present invention is most effectively applicable to the above-mentioned ink jet recording method utilizing the film boiling phenomenon.

We claim:

1. A recording head comprising:

a plurality of liquid emission sections, each having an orifice for emitting an ink;

a plurality of electrothermal transducers corresponding to said liquid emission sections, each said electro-thermal transducer including an electrode connected to a heating resistor layer for producing thermal energy for use in emission of ink supplied to said corresponding liquid emission section; and a plurality of functional elements, each electrically connected to said electrode of a corresponding said electrothermal transducer, wherein a layer of the same material as that of said heating resistor layer is disposed between each said functional element and said electrode of said corresponding electrothermal transducer.

2. A recording head according to claim 1, wherein said layer disposed between each said functional element and said electrode of said corresponding electrothermal transducer is formed from said heating resistor layer.

3. A recording head according to claim 1 or 2, wherein the material of said heating resistor layer is hafnium bromide.

4. A recording head according to claim 1 or 2, further comprising a function isolation region between said functional elements.

5. A recording head according to claim 4, wherein said function isolation region is grounded.

6. A recording head according to claim 2, wherein said electrothermal transducers produce a change of state of the ink to emit the ink from said orifices.

7. A substrate for a recording head, the substrate comprising:

a plurality of electrothermal transducers, each said electrothermal transducer including an electrode connected to a heating resistor layer for producing thermal energy for use in emission of ink from the recording head; and a plurality of functional elements, each electrically connected to said electrode of a corresponding said electrothermal transducer, wherein a layer of the same material as that of said heating resistor layer is disposed between each said functional element and said electrode of said corresponding electrothermal transducer.

8. A substrate according to claim 7, wherein said layer disposed between each said functional element and said electrode of said corresponding electrothermal transducer is formed from said heating resistor layer.

9. A substrate for recording head according to claim 7 or 8, wherein the material of said heating resistor layer is hafnium bromide.

10. A substrate according to claim 7 or 8, further comprising a function isolation region between said functional elements.

11. A substrate according to claim 7, wherein said function isolation region is grounded.

12. A recording apparatus comprising a recording head for recording by ink emission, said recording head including:

a plurality of liquid emission sections, each having an orifice for emitting ink toward a recording medium, a plurality of electrothermal transducers corresponding to said liquid emission sections, each electrothermal transducer including an electrode connected to a heating resistor layer for producing thermal energy for use in emission of ink supplied to said corresponding liquid emission section, and a plurality of functional elements, each electrically connected to said electrode of said corresponding electrothermal transducer, where a layer of the same material as that of said heating resistor layer is disposed between each said functional element and said electrode of said corresponding electrothermal transducer; and means for conveying the recording medium.

13. A recording apparatus according to claim 12, wherein said layer disposed between each said functional element and said electrode of said corresponding electrothermal transducer is formed from said heating resistor layer.

14. A recording apparatus according to claim 12 or 13, wherein the material of said heating resistor layer is hafnium bromide.

15. A recording apparatus according to claim 12 or 13, further comprising a function isolation region between said functional elements.

16. A recording apparatus according to claim 15, wherein said function isolation region is grounded.

* * * * *

UNITED STATES PATENT AND TRADEMARK OFFICE

CERTIFICATE OF CORRECTION

PATENT NO. : 5,157,419

DATED : October 20, 1992

INVENTOR(S) : SHIGEYUKI MATSUMOTO ET AL.

It is certified that error appears in the above-indentified patent and that said Letters Patent is hereby corrected as shown below:

COLUMN 1

Line 66, "functional" should read --functional device--.

COLUMN 3

Line 57, "between," should read --between--.

COLUMN 4

Line 42, "of the,." should read --of the--.

COLUMN 5

Line 2, "ments for" should read --ments, for--.

COLUMN 6

Line 36, "this" should read --these--.
Line 39, "$1X10^{19}10^{20}cm^{-3}$" should read --$1X10^{19}-10^{20}cm^{-3}$--.

COLUMN 7

Line 34, "to" should be deleted.

COLUMN 9

Line 21, "includes" should read --include--.
Line 22, "means pressurizing" should read --means, pressurizing--.
Line 40, "liquidous" should read --liquid--.

UNITED STATES PATENT AND TRADEMARK OFFICE

CERTIFICATE OF CORRECTION

PATENT NO. : 5,157,419

DATED : October 20, 1992

INVENTOR(S) : SHIGEYUKI MATSUMOTO ET AL.

It is certified that error appears in the above-indentified patent and that said Letters Patent is hereby corrected as shown below:

COLUMN 10

Line 21, "hafnium bromide." should read --hafnium boride.--.
Line 50, "hafnium bromide." should read --hafnium boride.--.
Line 57, "comprising" should read --comprising:--.

COLUMN 12

Line 5, "hafnium bromide." should read --hafnium boride.--.

Signed and Sealed this

Fourteenth Day of December, 1993

Bruce Lehman

*Attest:*

BRUCE LEHMAN

*Attesting Officer*

*Commissioner of Patents and Trademarks*